United States Patent [19]

Marer

[11] 4,296,686

[45] Oct. 27, 1981

[54] REMOTE CONTROL DEVICE FOR ACTIVATING OR INACTIVATING A PNEUMATIC WAR MINE

[75] Inventor: Joseph Marer, Lyss, Switzerland

[73] Assignee: Redon Trust, Schaan, Liechtenstein

[21] Appl. No.: 60,333

[22] Filed: Jul. 25, 1979

[30] Foreign Application Priority Data

Jul. 27, 1978 [CH] Switzerland ..... 8072/78

[51] Int. Cl.[3] ..... F42C 15/14

[52] U.S. Cl. ..... 102/427

[58] Field of Search ..... 102/19.2, 8

[56] References Cited

U.S. PATENT DOCUMENTS

| | | | |
|---|---|---|---|
| 2,411,787 | 11/1946 | Hammond, Jr. | 102/19.2 |
| 3,170,399 | 2/1965 | Hinman, Jr. | 102/19.2 |
| 3,282,212 | 11/1966 | Romano | 102/8 |
| 3,780,653 | 12/1973 | Stinchcomb | 102/19.2 |
| 4,143,598 | 3/1979 | Marer | 102/8 |

*Primary Examiner*—Charles T. Jordan

*Attorney, Agent, or Firm*—Saul Jecies

[57] ABSTRACT

A control device for activating or inactivating a pneumatic war mine, comprising one control signal receiving circuit, one circuit actuating an electromagnetic relay and one self-contained supply source. This power source is assembled in such a manner that it does not absorb any energy without the control signal and that it does not require any maintenance.

2 Claims, 1 Drawing Figure

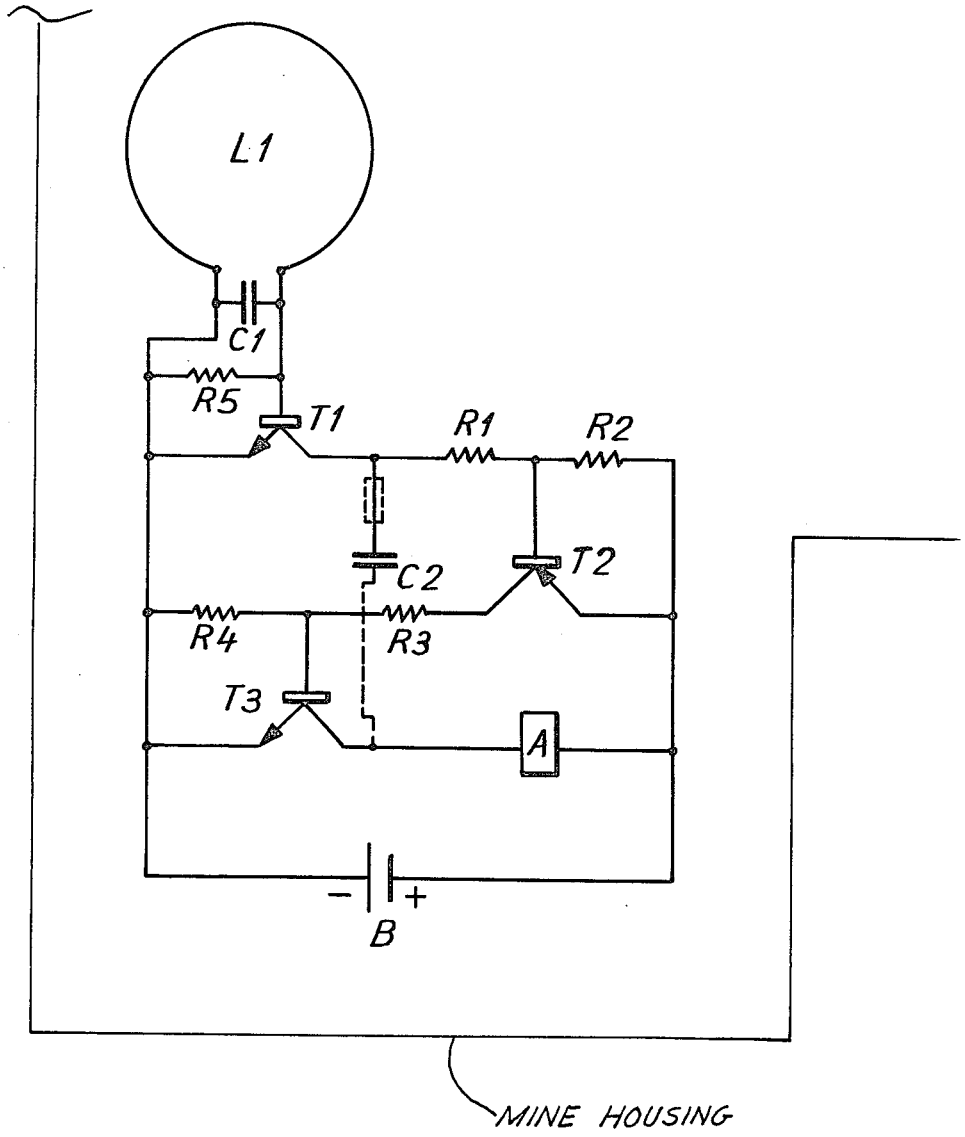
L1
C1
R5
T1
R1
R2
C2
T2
R4
R3
T3
A
B
MINE HOUSING

REMOTE CONTROL DEVICE FOR ACTIVATING OR INACTIVATING A PNEUMATIC WAR MINE

The object of this invention is a remote control device for activating or inactivating a pneumatic war mine such as an antipersonnel non-magnetic war mine such as described by the Swiss Pat. No. 598'563 and comprising a top chamber, a bottom chamber and a bag-shaped membrane.

A mine field effectively checks advancing enemy forces but it also impedes the movements of the minelaying troop. Such a field must be installed and remain active for a lengthy period as, for instance, several years without having to service its remote control device, to recharge or change its supply batteries. On the other hand, said device must allow for an exceptional intervention in order to inactivate the mines.

The object of this invention is to allow for activating or inactivating the mines according to requirements, either to prevent enemy forces from getting through or to allow passage for one's own troop.

The only FIGURE of the drawing shows, as an example and in the form of a diagram, the device object of this invention.

The device shown is controlled by a control signal that consists of an electromagnetic field of appropriate amplitude and frequency. Its receiving circuit with an antenna L1 and a tuning capacitor C1 is set to the same frequency as the control signal. Without any control signal, the transistors T1, T2 and T3 fail to absorb any energy from the power source, which is here a supply battery B, as their base has the same potential as the transmitter, i.e. the resistors R5, R2 and R4.

As soon as the voltage transmitted by the receiving circuit to the base of transistor T1 exceeds the threshold value of the connection, the transistor T1 starts absorbing power from the collector and, thanks to divider R1 and R2, activates transistor T2 which causes transistor T3 to start functioning through the intermediate of resistors R3 and R4. Consequently, the variation in the potential of the collector of transistor T3 arrives, carried over through the intermediate of capacitor C2, at the base of transistor T2 and causes, in consequence of the positive feedback building up, saturation of transistors T2 and T3 and actuation of the electromagnetic relay A.

As soon as the control signal ends, transistor T1 ceases to be conductive and transistors T2 and T3 are disconnected so that initial conditions are restored i.e. the device does no longer absorb any energy from the power source B.

By changing the value of capacitor C2 we cause a delay in the actuation of relay A.

If adjusted, for instance, to the mine described in the Swiss Pat. No. 598'563, the device described here will function as follows: as soon as the control signal actuates relay A, the latter will clear the passage between the top chamber and the bottom chamber. Any increase of the pressure in the top chamber is transmitted immediately to the bottom chamber so that the pressure in both chambers is balanced. Under these conditions, the bag-shaped membrane cannot inflate and the safety device of the mine is prevented from pivoting to release the striker. As soon as the signal ends, relay A will block the passage between the top chamber and the bottom chamber and the mine is then operational.

I claim:

1. In a pneumatic war mine, a remote control device for activating and deactivating the mine, comprising an electromagnetic relay operative for arming and disarming the mine;

a self-contained power supply;

a receiver circuit operative for receiving a transmitted control signal; and an electric control circuit connected with said relay, power supply and receiver circuit, said control circuit being normally passive and beginning to draw power from said power supply only upon being triggered by receipt of a control signal at said receiver circuit.

2. A remote control device as defined in claim 1; and further comprising an adjustable capacitor operative to delay the operation of said relay.

* * * * *